US005947048A

United States Patent [19]

McEntire

[11] Patent Number: 5,947,048

[45] Date of Patent: Sep. 7, 1999

[54] PERSONAL WATERCRAFT LANDING AID AND METHOD OF USE

[76] Inventor: Rick L. McEntire, 35 Lawerence 453, Walnut Ridge, Ark. 72476

[21] Appl. No.: 09/086,860

[22] Filed: May 29, 1998

[51] Int. Cl.[6] ..... B63B 59/02

[52] U.S. Cl. ..... 114/219; 405/1

[58] Field of Search ..... 114/221 R, 343, 114/344, 219, 230, 293, 361; 405/1, 7; 188/6, 7, 32

[56] References Cited

U.S. PATENT DOCUMENTS 2,940,414 6/1960 Moore ..... 114/219

4,803,942 2/1989 Dren et al. ..... 405/1

5,477,802 12/1995 Laue ..... 114/219

5,577,455 11/1996 Dvorak ..... 405/1

*Primary Examiner*—Stephen Avila

*Attorney, Agent, or Firm*—Joe D. Calhoun

[57] ABSTRACT

A portable device for submerging near the shoreline of a waterway, for supporting and mooring a watercraft therein, comprising a base with lower footings adapted to prevent slippage along the bank of the shoreline, and corresponding pairs of upper runners for supporting the watercraft hull during landing and mooring.

22 Claims, 4 Drawing Sheets

PERSONAL WATERCRAFT LANDING AID AND METHOD OF USE

BACKGROUND OF THE INVENTION

The invention described herein generally relates to devices, systems and methods for landing watercraft near a waterway shoreline for purposes of embarcation or disembarcation, mooring the watercraft at or near the shoreline, and perhaps storing the watercraft out of the water during periods of non-use. More specifically, the present invention relates to a device sufficiently portable to accompany an outing on personal watercraft, for submerging near a shoreline to protect the hull during landing and mooring. The use of watercraft for recreation and competition has increased greatly in the past few years. The watercraft to which the present invention relates includes personal watercraft (also commonly known by the names jet ski, wave runner or similar moniker) as well as traditional recreational boats such as those used for fishing, skiing, or touring the waterway. In general, a personal watercraft is typically operated by one person in a waterway, although many designs allow for the transport of additional riders.

While the hull of many a watercraft is made of aluminum and/or fiberglass, it can be easily damaged when a person attempts to land or moor the watercraft in shallow water at the edge of a shoreline. Depending upon the frequency and size waves, and the terrain of the waterway floor and shoreline, watercraft may be repeatedly and vigorously pushed by wind or waves into contact with abrasive elements along or near the shoreline, such as shale or other rock formations, trees or stumps, or other elements that may gouge or crack the watercraft hull. One solution to this problem has been to position a shock-insulating device (such as unused car tire) near the shoreline, for either placing under the hull of the moored watercraft or for anchoring the watercraft offshore in deeper water.

A search of patents has revealed that inventors have recognized the problems identified above, and have proposed various devices or systems to overcome at least some aspects thereof Patents which describe systems which aid in landing or mooring watercraft include U.S. Pat. No. 2,462,964 to Heggen; U.S. Pat. No. 5,066,033 to Kolstad et al.; U.S. Pat. No. 3,879,060 to Slack et al.; and U.S. Pat. No. 4,911,459 to Smyly.

A study of known patents indicates that, while inventors have provided specific devices or systems which solve some aspects of the problems associated with the securing and storing of watercraft, there is a need for additional systems and methods of their use. The patents and other references known in the art lack one or more essentials features of the invention disclosed herein.

SUMMARY OF THE INVENTION

In general, this application pertains to a portable device for submerging near the shoreline of a waterway, for supporting and mooring a watercraft therein; this invention also generally pertains to methods of using the portable device. The portability of the present invention on personal watercraft is one particular feature distinguishing it from previous devices; another particular distinguishing feature is the greater amount of hull protection provided by the invention, while simultaneously retaining it portability.

While in water, watercraft are typically buoyant and relatively easy to maneuver, even by individuals having weak or small stature. One common landing or beaching method involves running the watercraft as close to shore as possible, then securing one end of a rope to the bow of the watercraft and securing the other end to an immovable object on the shore. However, this method often results in damage to the watercraft hull, and the terrain of the shoreline does not always permit the watercraft to be landed or moored close enough to shore to reach without requiring wading or swimming. Such existing methods are often difficult for the elderly and small-statured individuals such as children, and existing methods may also be dangerous (or even life threatening) for individuals who cannot wade or swim well enough to reach shore without entering the water or being carried to shore.

A search of patents shows that inventors have appreciated the identified problems and have provided specific systems which serve to help overcome some of the problems associated with the securing and storage of watercraft. However, there remains a need for better devices and methods of their use which aid users of watercraft, particularly in the process of beaching and/or storage of watercraft without damage thereto. There is also a need for a compact device able to be transported aboard personal watercraft, providing complete protection of the watercraft hull from damage by the waterway floor and shoreline of islands and other destinations reachable by personal watercraft but not necessarily by conventional land transportation.

One primary object of this invention is to provide a watercraft landing device sufficiently light and compact to accompany an outing on a personal watercraft, for use at any landing site. Another primary object of this invention is to provide a watercraft landing device that fully protects the prow of the watercraft. Other objects of the present invention are to provide a watercraft landing device that is relatively easy and inexpensive to manufacture, and relatively simple to use. The invention described herein satisfies all of these objects, and more objects that will become apparent to the reader upon review of this application.

DETAILED DESCRIPTION OF THE INVENTION

For the sake of simplicity and to give the claims of this patent application the broadest interpretation and construction possible, the following definitions will apply:

a. The word "Edge" means a border side of the device (such as between the Prow End and Stern End); although the figures depict a respective version of the device having one version of an Edge, the device should not be limited to the versions depicted; an Edge may be a frame of reference rather than a distinct line or point.

b. The words "footing material" mean any material or combination of materials that is sufficiently rigid to withstand interfacing with the waterway floor (without deteriorating quickly) while supporting and mooring a watercraft when the device is submerged and essentially sandwiched between the waterway floor and the watercraft hull; such material(s) could be identical to runner material, and vice versa, to the extent that the structural and functional attributes of each are satisfied by the same material(s).

c. The word "integral" means essentially unitary construction, or constructed as an extension of the same element or component.

d. The words "longitudinal axis" mean an imaginary line down essentially the center of the device, from the Prow End to the Stern End; it is a frame of reference rather than a limiting element of the device.

e. The words "rectangulo-cuboidal" mean an essentially rectangular body having, in three-dimensional terms, a long box-like body.

f. The words "runner material" mean any material or combination of materials available that is sufficiently rigid to support a watercraft without damaging the hull (and without deteriorating quickly).

g. The word "terminus" means a border side of an Area (such as the Prow Area or Stern Area), essentially transversing the device from one Edge to another; it may be a frame of reference rather than a distinct line or point, while the respective "Area" may have no demarcated terminus border.

Also for the sake of simplicity, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

Figure 1:
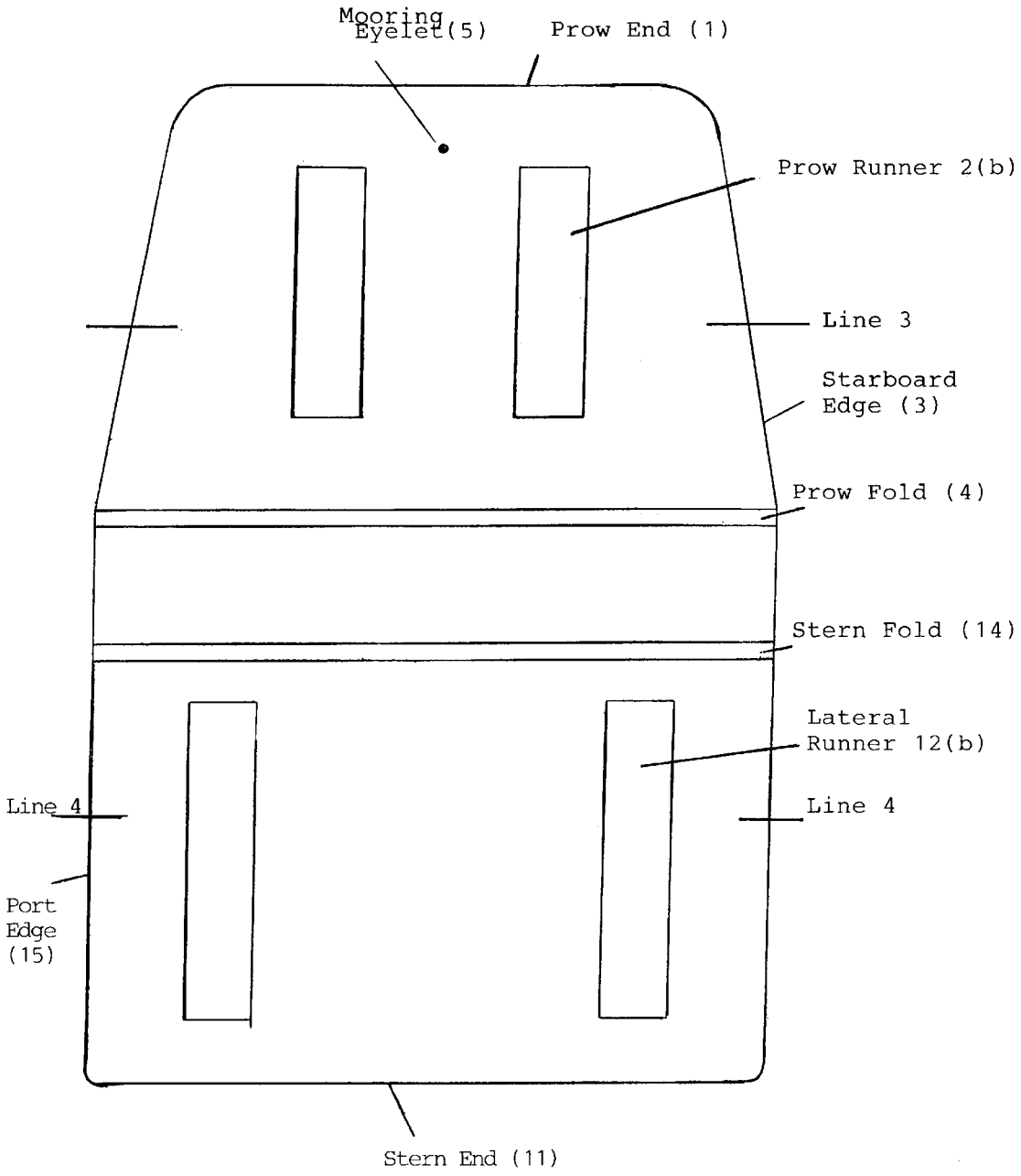
FIG. 1 depicts one version of the beaching device of the present invention in the Outstretched Position, as viewed from above looking down on the Upper Plane of the Base. Visible are a corresponding pair of parallel Prow Runners (2(*a*) and 2(*b*)) extending longitudinally from near the Prow End (1) to near the terminus of the Prow Area (located near the Prow Fold), the corresponding pair of parallel Lateral Runners (12(*a*) and 12(*b*)) extending longitudinally from near the Stern End (11) to near the terminus of the Stern Area (located near the Stern Fold), the Starboard Edge (3) and the Port Edge (15) and the Mooring Eyelet (5).

In its most general form the invention comprises a portable device for submerging near the shoreline of a waterway, for supporting and mooring a watercraft therein, comprising an essentially planar Base having a Prow End and an essentially opposite Stern End and extending along a longitudinal axis therebetween, essentially bounded by a lateral Port Edge and an essentially opposite lateral Starboard Edge; said Ends and Edges define an Upper Plane and an essentially opposite Lower Plane of said Base, each respective Plane having a Prow Area and Stern Area. Each respective Prow Area of said Planes comprises an area of the respective Plane essentially defined by the respective Prow End and both respective Edges and a terminus less than (but near) midway along said longitudinal axis from said Prow end. In FIG. 1, the Prow Area is essentially an area of the Upper Plane having peripheral edges extending essentially counter clockwise beginning from the juncture point of the Prow Fold with the Starboard Edge, then along the Starboard Edge and around the Prow End, then along the Port Edge to the juncture of said Prow Fold with the Port Edge, then along said Prow Fold to the original point of beginning.

Each respective Stern Area of said Planes comprises an area of the respective Plane essentially defined by the respective Stern End and both respective Edges and a terminus less than (but near) midway along said longitudinal axis from said Stern End. In FIG. 1, the Stern Area is essentially an area of the Upper Plane having peripheral edges extending essentially clockwise beginning from the juncture point of the Stern Fold with the Starboard Edge, then along the Starboard Edge and around the Stern End, then along the Port Edge to the juncture of the Stern Fold with the Port Edge, then along the Stern Fold to the original point of beginning.

This form of the invention also comprises at least one corresponding pair of essentially rigid Footings (preferably essentially parallel to each other), each downstanding permanently from the Lower Plane and separated essentially equidistantly from the other by said longitudinal axis, and extending longitudinally along said longitudinal axis from near the Stern End at least to near the terminus of the Stern Area. Each such Footing has a lowermost longitudinal edge furthest distal to the Lower Plane, said Footing edge adapted to prevent slippage of the device along the waterway floor when the Footing edge is submerged into contact with the waterway floor. Such adaptation may be in the form of a tapering down of said longitudinal edge, which contacts the floor of the waterway near the shoreline; preferably the tapering down occurs in an essentially stair-stepped or jagged fashion more capable of grasping irregularities in the terrain and preventing the device from sliding down the submerged bank of the waterway. The angular stair-stepping allows the invention to adjust to the incline of a shoreline, and such adjustability may be further augmented by the flexing of the device downward at a Folding Adaptation described herein.

This form of the invention also comprises at least one corresponding pair of essentially rigid Runners, each upstanding permanently from the Upper Plane and separated essentially equidistantly from the other by said longitudinal axis, and extending longitudinally along said longitudinal axis from near the Prow End to near the Stern End. Each such Runner has an apical surface adapted to support a portion of the hull of the watercraft without damaging it. Such adaptation may include a surface beveled or chamferred to maximize and maintain contact with the watercraft hull; such adaptation may also comprise one of more Runner Pad(s) fixed to the apical surface of each Runner, comprised of the same or similar materials (or combinations thereof).

In a more detailed version of the invention, said Runners are comprised of at least one corresponding pair of Prow Runners and at least one corresponding pair of Lateral Runners, each member of each respective pair of such Runners separated essentially equidistantly from the other member by said longitudinal axis and extending longitudinally along said longitudinal axis. (The separation between the Prow Runners may be less than the separation between the Lateral Runners, and said differential separation may be sufficient to allow the device to be folded as is explained hereinbelow.) The Prow Runners extend longitudinally along the Prow Area from near the Prow End to near the terminus of the Prow Area, whereas the Lateral Runners extend longitudinally along the Stern Area from near the Stern End to near the terminus of the Stern Area.

In the more general version of the invention, each of said Runners is comprised of essentially a rectangulo-cuboidal block of submersible material sufficiently rigid to support and moor a watercraft when the device is submerged and essentially sandwiched between the waterway floor and the watercraft hull (herein "runner material"); as an example of runner material(s) currently available, the Runners may be constructed of essentially water resistant polymer material such as polyurethane, styrene-butadiene, thermoplastic elastomers, and combinations thereof Each of said Runners may have the following approximate ranges of dimensions: 4 inches to about 14 inches long, inch to about 4 inches wide, and 2 inches to about 8 inches tall (upstanding above the Upper Plane). Each such block is essentially permanently attached to the Upper Plane of the Base. In the more specific version, each of said Prow Runners is comprised of essentially a rectangulo-cuboidal block of water resistant polymer material such as polyurethane, styrene-butadiene, thermoplastic elastomers, and combinations thereof, having the following approximate dimensions: 7½ inches long, 2 inches wide, and 2¾ inches tall. Each of said Lateral Runners is comprised of essentially a rectangulo-cuboidal block of runner material(s) having essentially the same physical characteristics as the Prow Runners, and having the following approximate dimensions: 9½ inches long, 2 inches wide, and 3½ inches tall. All such Runners are essentially permanently attached to the Upper Plane of the Base.

Regardless of whether you are considering either the general form of the invention or the more specific versions, said adaptation to the apical surface of the Runners may be comprised of a tiltable Runner Pad having at least one essentially hinged attachment atop the respective Runner, allowing each respective Runner Pad to tilt toward the longitudinal axis sufficient to essentially reflect the prevailing angle of the hull of the watercraft adjacent thereto. In general, each of said Runner Pads is comprised of essentially a rectangulo-cuboidal block of runner material(s) having essentially the same physical characteristics as the Prow Runners, and having the essentially the same length and width as the Runner to which it is attached, and approximately ½ inch to about 4 inches tall (upstanding from the apical surface of the respective Runner). More specifically, each of said Runner Pads is comprised of essentially a rectangulo-cuboidal block of runner material(s) having essentially the same length and width as the Runner to which it is attached, and approximately 1 inch tall. Each Runner Pad is attached to a respective Runner at one or more points along the length of the apical surface of the Runner, preferably by means of one or more stainless steel rods acting essentially as hinge pins. This being the only metal in this version of the invention, it will not rust or corrode, making the invention freshwater and or saltwater capable.

Figure 2:
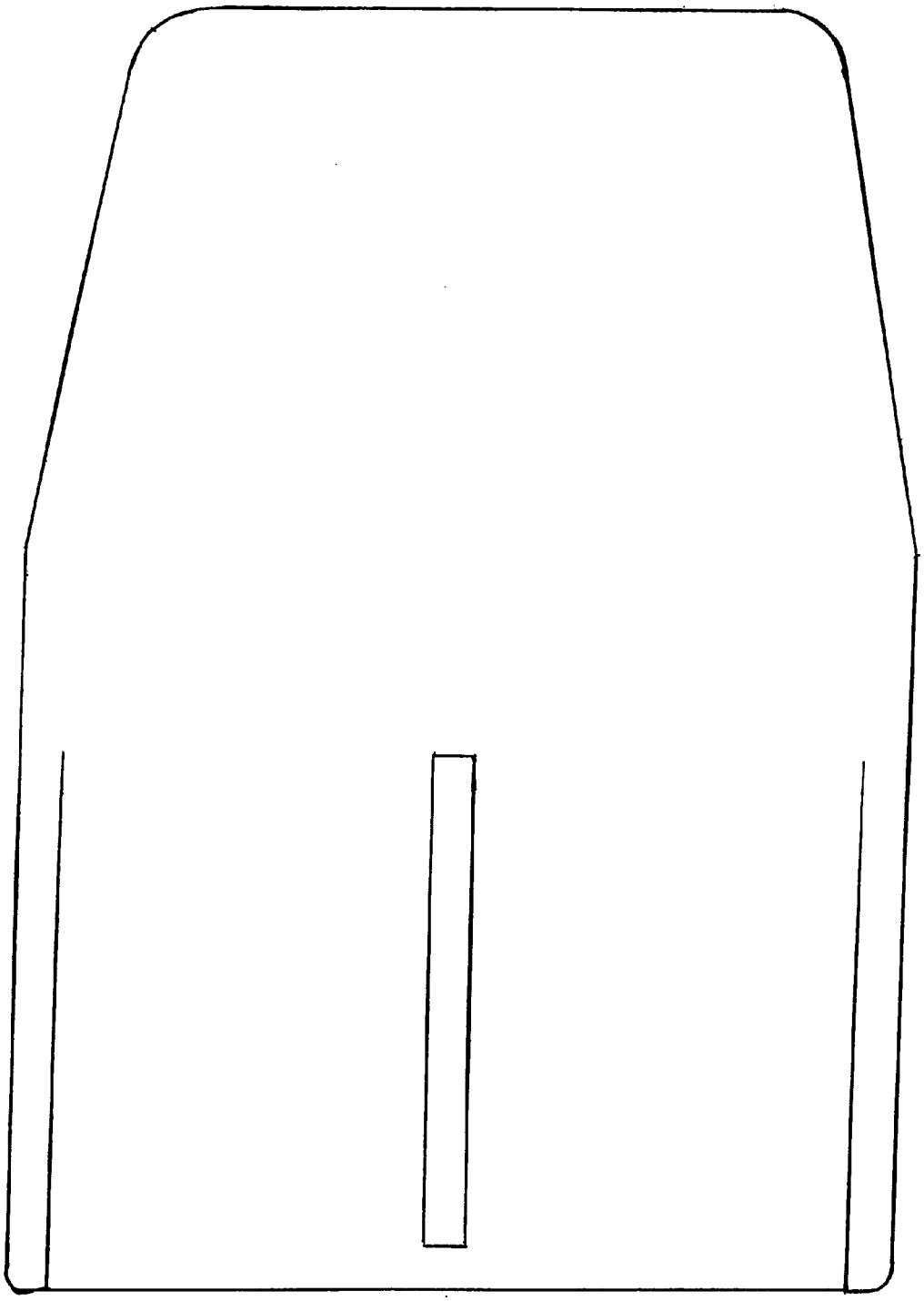
FIG. 2 depicts an embodiment of the invention viewed from below, looking up at the Lower Plane of the Base. Visible are a corresponding triad Footings (22(*a*), 23 and 22(*b*)) in the Stern Area of the Lower Plane.
Figure 3:
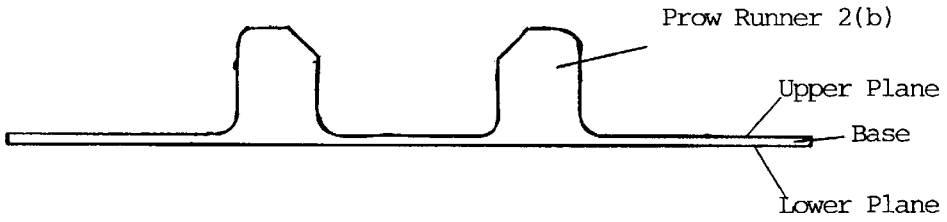
FIG. 3 depicts a cross sectional view of the embodiment of FIG. 1, at line 3—3. Visible are the Base and its upstanding pair of Prow Runners.

In a more specific version of the invention, depicted in FIG. 2, said Footings are comprised of at least a corresponding triad of essentially parallel elongate Footings, namely, a Starboard Lateral Footing extending longitudinally near the Starboard Edge, a Port Lateral Footing extending longitudinally near the Port Edge, and an Axis Footing extending along the longitudinal axis intermediate between the respective Lateral Footings and essentially equidistant therefrom. In one preferred version, the Footings terminate (run essentially flush with the Lower Plane) near the terminus of the Stern Area. (The other end of the Axis Footing, nearest to the Stern End, may be a sufficient distance (perhaps an inch or so) from the Stern End to allow the attachment or location of other members of the device, as explained elsewhere herein.) The corresponding downstanding height of each Footing tapers down from the Stern End towards the Prow End in an essentially stair-stepped fashion, each Footing thereby having an essentially stair-stepped lowermost longitudinal edge furthest distal to the Lower Plane, with the outwardly/downwardly pointed corner of each stair step capable of stubbing against irregularities along the floor of the waterway to thereby prevent slippage of the device along the waterway floor when the Footing edge is submerged into contact with the waterway floor.

In the general version of the invention, each of said Footings extends longitudinally from near the Stern End to near the terminus of the Stern Area, irrespective of whether the Base has any Folding Adaptation(s). Each of said Footings is comprised of essentially a rectangulo-cuboidal block of footing material having the following approximate ranges of dimensions, and being essentially permanently attached to the Lower Plane of the Base: 4 inches to about 14 inches long, 1 inch to about 4 inches wide, and essentially stair-stepped tapering down height from between about 8 inches to about 2 inches tall near the Stern End to a height of about 1 inch tall to about flush with the Lower Plane near the terminus of the Stern Area. In a more specific version of the invention, as depicted in FIG. 2, each of said Footings is comprised of essentially a rectangulo-cuboidal block of the previously described runner material and having the following approximate dimensions, essentially permanently attached to the Lower Plane of the Base: 12 inches long, 1 inch wide, and essentially stair-stepped tapering down height from about 3¾ inches tall near the Stern End to about flush with the Lower Plane near the terminus of the Stern Area.

Figure 5:
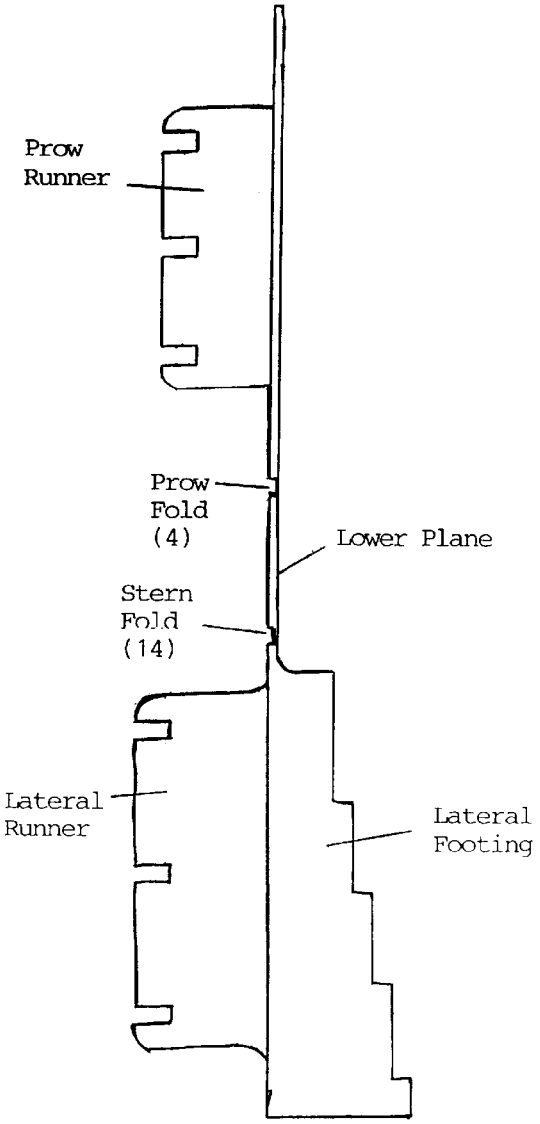
FIG. 5 depicts a side view of the device of FIG. 1. Visible are a Lateral Footing and its essentially stair-stepped tapering lowermost edge furthest distal to the Lower Plane, a Prow Runner adapted to receive a Runner Pad (FIGS. 6 and 7), a Prow Fold and a Stern Fold.

Alternatively, another version utilizes currently available manufacturing techniques with currently available molded plastic(s) such as (for example) polyurethane, styrene-butadiene, thermoplastic elastomers, polyvinyl chloride, and combinations thereof, resulting in an integral single-piece unit having the Base, Runners (without Runner Pads) and Footings. For example, FIG. 5 depicts a version wherein each of said Footings is comprised of an integral protrusion from the Lower Plane. In general, each of said protrusions has the following approximate ranges of dimensions: 4 inches to about 14 inches long, 1 inch to about 4 inches wide, and essentially stair-stepped tapering down height from between about 8 inches to 2 inches tall near the Stern End to a height of about 1 inch tall to about flush with the Lower Plane near the terminus of the Stern Area. More specifically, each of said Footings is comprised of an integral protrusion from the Lower Plane comprised of footing material, each of said protrusions having the following approximate dimensions: 12 inches long, 1 inch wide, and essentially stair-stepped tapering down height from about 3¾ inches tall near the Stern End to about flush with the Lower Plane near the terminus of the Stern Area.

In this version using integral, unified construction, each of said Runners is comprised of an integral protrusion upstanding from the Upper Plane comprised of runner material, having the following approximate ranges of dimensions: 4 inches to about 14 inches long, 1 inch to about 4 inches wide, and 2 inches to about 8 inches tall. More specifically, each of said Prow Runners is comprised of an integral protrusion upstanding from the Upper Plane comprised of runner material, each Prow Runner having the following approximate dimensions: 7½ inches long, 2 inches wide, and 2¾ inches tall. Each of said Lateral Runners is comprised of an integral protrusion upstanding from the Upper Plane comprised of runner material, each Lateral Runner having the following approximate dimensions: 9½ inches long, 2 inches wide, and 3½ inches tall.

The more specific versions of the invention, having at least two corresponding pairs of aligned Runners, may also have at least one Folding Adaptation facilitating the essentially hinged folding of the Base along a latitudinal axis about midway along and essentially perpendicular to the longitudinal axis, facilitating the folding of said apparatus from an Outstretched Position to a Folded Position. Said hinging adaptation is comprised of the creasing or routing out of a groove or channel on the Base, preferably the Upper Plane of the Base.

Alternatively, said Folding Adaptation is comprised of bisection of the Base along a latitudinal axis about midway along and essentially perpendicular to the longitudinal axis, both of said sections of the Base hingedly joined by at least one hinge member. Another more compact version of the invention includes a corresponding pair of Folding Adaptations, namely a Prow Fold near the terminus of the Prow Area and an essentially parallel Stern Fold near the terminus of the Stern Area; each such Folding Adaptation is separated from the other by a distance slightly longer than the tallest Runners (including any Runner Pads atop said Runners), and allowing folding of the Prow Area of the Upper Plane of the Base inwardly with corresponding inward folding of the Stern Area of the Upper Plane of the Base. Said corresponding pair of Prow Runners and corresponding pair of Lateral Runners are cooperatively aligned to allow such folding without interference by the obstruction of any Runners, thereby resulting in the folding of the device from an Outstretched Position to a Folded Position having the Runners essentially sandwiched between the inwardly folded Upper Planes.

The invention may have several supplemental features that increase its utility. It may include at least one corresponding pair of Stabilizing Eyelets through said Lateral Runners or through said Planes near each Lateral Edge, each respective Stabilizing Eyelet located near the Stern End and the respective Starboard Edge or the Port Edge. (All Eyelets may be formed by drilling through the respective element of the device, or by modifying the device-forming mold to provide for the Eyelets.) Each Stabilizing Eyelet is adapted to receive and temporarily tightly anchor an end of essentially elongate securing material (such as one or more section of rope or strapping material). Using one rope or strap, a first end is received by and anchored to said one Stabilizing Eyelet (for example the Eyelet through the Starboard Lateral Runner), and the opposite end two is similarly received and anchored by the other corresponding Stabilizing Eyelet (for example the Eyelet through the Port Lateral Runner), then cinched taut over the watercraft to thereby prevent separation of the watercraft from the Runners. Using separate ropes or straps anchored to separate Stabilizing Eyelets, each first end of each section of rope or strap is received by and anchored to the respective Stabilizing Eyelet, and each respective end two of the rope or strap is secured to the watercraft and separately cinched taut against the watercraft to thereby prevent separation of the watercraft from the Runners. Alternatively, each Stabilizing Eyelet may be sized to allow a knotted rope to be pulled through from the axis side out toward the lateral edge until the knot abuts against the Footing, the knot unable to slip through the Eyelet, thereby securing the knotted end of the rope to the Footing and allowing the opposite end of the rope to be attached to the watercraft. All securing materials such as ropes or straps preferably include nylon or other water resistant characteristics.

It may also include at least one Auxiliary Member (such as a strap) having at least a pair of opposite ends, a first end of said member being attached to the Base near the Prow End (preferably along the longitudinal axis of the Lower Plane), the opposite end two of said member being adapted to facilitate the grasping of the device and maintaining the device in the Folded Position. Said end two may have a graspable means (such as a loop or a knob) and having a means of temporarily attaching said end two near the Stern End (such as a snap member) once the device is folded into the Folded Position. In one version, the device has a nylon strap attached at its first end to the Lower Plane near the Prow End, near the longitudinal axis, and with its end two forming a loop also having a snap member attached to the outer surface of said loop; there is a corresponding snap member attached to the Lower Plane near the Stern End, near the longitudinal axis, which engages the strap snap member. The length of the strap allows the handler to grasp the device in the Outstretched Position, and it maintains the device in the Folded Position.

The invention may also include at least one Mooring Eyelet through said Planes near the Prow End and essentially equidistant from the longitudinal axis, adapted to receive a means of fixing the position of the device in the Outstretched Position on the shoreline. Lastly, the invention may include at least one Detection System attached to the submerged device and extending essentially directly upward to the surface of the waterway, to facilitate the location of the device after submersion.

More particularly, said Stabilizing Eyelets may be molded integrally with the device, or drilled through the device after preliminary fabrication. Eyelets may also be bordered by grommet or other protective material. Said securing material may be selected from the group consisting of rope, cord, strapping and any other similar material having the necessary structural strength and flexibility to accomplish the functions described herein, and combinations thereof. Said Auxiliary Member may also be selected from said group. Said Detection System may be selected from the group consisting of at least one elongate antennae extending upwardly to the surface of the waterway and having a flag attached to the apex, or at least one flotation apparatus attached to securing material having sufficient length to allow said flotation apparatus to be visible above the surface of the waterway, and any other similar materials or combinations thereof having the necessary characteristics to accomplish the functions described herein.

Figure 4:
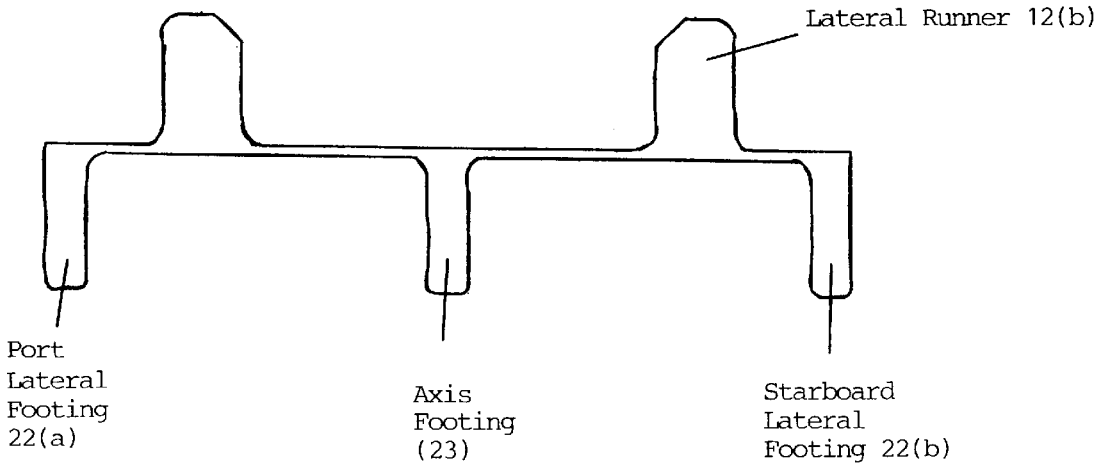
FIG. 4 depicts a cross sectional view of the embodiment of FIG. 1, at line 4—4. Visible are the Base, its upstanding Lateral Runners, and its downstanding triad of Footings.
Figure 6:
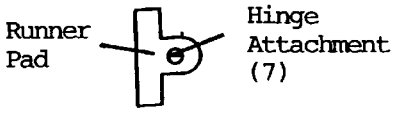
FIG. 6 depicts a cross sectional view of a Runner Pad, at line 6—6 of FIG. 7.
Figure 7:
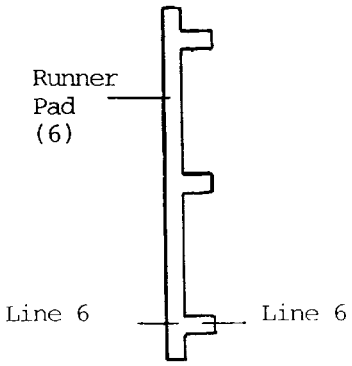
FIG. 7 depicts a side view of a Runner Pad as if it were disconnected from FIG. 5.

The version of the invention depicted in FIG. 4 is an example of a preferred embodiment. That figure depicts a portable device for submerging near the shoreline of a waterway, for supporting and mooring a watercraft therein, comprising an essentially planar Base having a Prow End and an essentially opposite Stern End and extending along a longitudinal axis therebetween, essentially bounded by a lateral Port Edge and an essentially opposite lateral Starboard Edge, said Ends and Edges defining an Upper Plane and an essentially opposite Lower Plane of said Base. Each respective Plane has a Prow Area and Stern Area, as described hereinabove. There is a corresponding triad of essentially parallel elongate Footings, each Footing downstanding permanently from the Lower Plane and extending longitudinally from near the Stern End to the terminus of the Stern Area. Said triad is comprised of a Starboard Lateral Footing extending longitudinally near the Starboard Edge, a Port Lateral Footing extending longitudinally near the Port Edge, and an Axis Footing extending along the longitudinal axis intermediate between the respective Lateral Footings and essentially equidistant therefrom. The corresponding downstanding height of each Footing tapers down from the Stern End towards the Prow End in an essentially stair-stepped fashion, each Footing thereby having an essentially stair-stepped lowermost longitudinal edge furthest distal to the Lower Plane, with the outwardly/downwardly pointed corner of each stair step capable of stubbing against irregularities along the floor of the waterway to thereby prevent slippage of the device along the waterway floor when the device is submerged into contact with the waterway floor. Each Footing is comprised of an integral protrusion from the Lower Plane comprised of footing material, having the following approximate dimensions: 12 inches long, 1 inch wide, and essentially stair-stepped tapering down height from about 3¾ inches tall near the Stern End to about flush with the Lower Plane near the terminus of the Stern Area.

This embodiment includes at least one corresponding pair of essentially rigid Prow Runners and at least one corresponding pair of essentially rigid Lateral Runners, each member of each respective pair of such Runners upstanding permanently from the Upper Plane and separated essentially equidistantly from the other by said longitudinal axis, and extending longitudinally along said longitudinal axis from near the Prow End to near the Stern End. The Prow Runners have less separation than the separation between the Lateral Runners, and the Prow Runners extend longitudinally along the Prow Area from near the Prow End to near the terminus of the Prow Area whereas the Lateral Runners extend longitudinally along the Stern Area from near the Stern End to near the terminus of the Stern Area. Each of said Prow Runners is comprised of an integral protrusion upstanding from the Upper Plane comprised of runner material, each of said Prow Runners having the following approximate dimensions: 7½ inches long, 2 inches wide, and 2¾ inches tall. Each of said Lateral Runners is comprised of an integral protrusion upstanding from the Upper Plane comprised of runner material, having the following approximate dimensions: 9½ inches long, 2 inches wide, and 3½ inches tall.

In this embodiment, each Runner has an apical surface adapted to support a portion of the hull of the watercraft without damaging it, said adaptations of the apical surface of each such Runner comprised of a tiltable Runner Pad having at least one hinged attachment atop the respective Runner, allowing each respective Runner Pad to tilt toward the longitudinal axis sufficient to essentially reflect the prevailing angle of the hull of the watercraft adjacent thereto. Each Runner Pad is comprised of essentially a rectangulo-cuboidal block of the runner material(s) described above and having essentially the same length and width as the Runner to which it is attached, and approximately 1 inch tall.

This embodiment also includes a corresponding pair of Folding Adaptations of the Base, facilitating the essentially hinged folding of the Base along a latitudinal axis about midway along and essentially perpendicular to the longitudinal axis. Said Base adaptations include a Prow Fold near the terminus of the Prow Area and an essentially parallel Stern Fold near the terminus of the Stern Area, each Fold comprised of the creasing or routing out of a groove on the Base, preferably the Upper Plane of the Base, sufficient to allow the folding of the Base without substantially decreasing the structural strength of the Base. Each Fold is separated from the other by a distance slightly longer than the tallest of the Runners (including any Runner Pads atop said Runners), allowing folding of the Prow Area of the Upper Plane of the Base inwardly with corresponding inward folding of the Stern Area of the Upper Plane of the Base, thereby facilitating the folding of the device from an Outstretched Position to a Folded Position. In this embodiment, said corresponding pair of Prow Runners and corresponding pair of Lateral Runners are cooperatively aligned to allow such folding without interference by the obstruction of any Runners, thereby resulting in the folding of the device from an Outstretched Position to a Folded Position having the Runners between the inwardly folded Upper Planes.

Besides the devices described herein, the invention also includes a method of using said devices. The invention includes a method of supporting and mooring a watercraft near the shoreline of a waterway, comprising the steps of submerging the device at or near the shoreline of a waterway, a sufficient depth to allow the desired watercraft to float partially over and between the Runners. Next, floating the prow of the watercraft over and between the corresponding Runner pair(s) until properly positioned to allow the Runner Pads to reflect the angle of the watercraft hull. Then, securing the watercraft to the device via the stabilizing eyelets and securing members.

Securing the device to the shoreline can be accomplished by driving a stake into the Mooring Eyelet. It should be noted that additional Eyelets can be made in the Prow End to provide additional securing of the device along the shoreline, depending upon the size of watercraft. The Mooring Eyelet may also serve as a place to tie a rope to the prow end of the watercraft and/or the shoreline. It should also be noted that there are a variety of sizes of watercraft that the present invention can fit. There are also different techniques of securing watercraft, depending upon watercraft size and conditions such as weather, waves, and shoreline.

I claim:

1. A portable device for submerging near the shoreline of a waterway, between the waterway floor and the hull of a watercraft, for supporting and mooring the watercraft therein, comprising:

an essentially planar Base having a Prow End and an essentially opposite Stern End and extending along a longitudinal axis therebetween, essentially bounded by a lateral Port Edge and an essentially opposite lateral Starboard Edge, said Ends and Edges defining an Upper Plane and an essentially opposite Lower Plane of said Base, each respective Plane having a Prow Area and Stern Area, with each respective Prow Area of said Planes comprising an area of the respective Plane essentially defined by the respective Prow End and both respective Edges and a terminus not quite midway along said longitudinal axis from said Prow End, and with each respective Stern Area of said Planes comprising an area of the respective Plane essentially defined by the respective Stern End and both respective Edges and a terminus less than but near midway along said longitudinal axis from said Stern End;

at least one corresponding pair of essentially rigid Footings, each downstanding permanently from the Lower Plane and separated essentially equidistantly from the other by said longitudinal axis, and extending longitudinally along said longitudinal axis from near the Stern End at least to the terminus of the Stern Area, each such Footing having a lowermost surface furthest distal to the Lower Plane, said distal surface adapted to prevent slippage of the device along the waterway floor when the device is submerged into contact with the waterway floor;

at least one corresponding pair of essentially rigid Runners, each upstanding permanently from the Upper Plane and separated essentially equidistantly from the other by said longitudinal axis, and extending longitudinally along said longitudinal axis from near the Prow End to near the Stern End, each such Runner having an apical surface adapted to support a portion of the hull of the watercraft without damaging it.

2. The device of claim 1 hereinabove, wherein:

said Runners are comprised of at least one corresponding pair of Prow Runners and at least one corresponding pair of Lateral Runners, each member of each respective pair of such Runners separated essentially equidistantly from the other member by said longitudinal axis and extending longitudinally along said longitudinal axis, but whereas the separation between the Prow Runners is less than the separation between the Lateral Runners, and whereas the Prow Runners extend longitudinally along the Prow Area from near the Prow End to near the terminus of the Prow Area while the Lateral Runners extend longitudinally along the Stern Area from near the Stern End to near the terminus of the Stern Area.

3. The device of claim 2 hereinabove, wherein:

each of said Runners is comprised of essentially a rectangulo-cuboidal block of runner material, each of said Runners having the following approximate ranges of dimensions, essentially permanently attached to the Upper Plane of the Base:

a. 4 inches to about 14 inches long;
b. 1 inch to about 4 inches wide; and
c. 2 inches to about 8 inches tall.

4. The device of claim 2 hereinabove, wherein:

each of said Prow Runners is comprised of essentially a rectangulo-cuboidal block of runner material having the following approximate dimensions, essentially permanently attached to the Upper Plane of the Base:

a. 7½ inches long,
b. 2 inches wide, and
c. 2¾ inches tall; and each of said Lateral Runners is comprised of essentially a rectangulo-cuboidal block of runner material having the following approximate dimensions, essentially permanently attached to the Upper Plane of the Base:

a. 9½ inches long;
b. 2 inches wide; and
c. 3½ inches tall.

5. The device of claim 2 hereinabove, wherein each of said Runners is comprised of an integral protrusion upstanding from the Upper Plane comprised of runner material, having the following approximate ranges of dimensions:

a. 4 inches to about 14 inches long;
b. 1 inch to about 4 inches wide; and
c. 2 inches to about 8 inches tall.

6. The device of claim 2 hereinabove, wherein:

each of said Prow Runners is comprised of an integral protrusion upstanding from the Upper Plane comprised of runner material, each Prow Runner having the following approximate dimensions:

a. 7½ inches long,
b. 2 inches wide, and
c. 2¾ inches tall; and each of said Lateral Runners is comprised of an integral protrusion upstanding from the Upper Plane comprised of runner material, each Lateral Runner having the following approximate dimensions:

a. 9½ inches long,
b. 2 inches wide, and
c. 3½ inches tall.

7. The device of claim 2 hereinabove, wherein:

each of said adaptations of the apical surface of each such Runner is comprised of a tiltable Runner Pad having at least one hinged attachment atop the respective Runner, allowing each respective Runner Pad to tilt toward the longitudinal axis sufficient to essentially reflect the prevailing angle of the hull of the watercraft adjacent thereto.

8. The device of claim 7 hereinabove, wherein each of said Runner Pads is comprised of essentially a rectangulo-cuboidal block of runner material having essentially the same length and width as the Runner to which it is attached, and approximately ½ inch to about 2 inches tall.

9. The device of claim 7 hereinabove, wherein each of said Runner Pads is comprised of essentially a rectangulo-cuboidal block of runner material having essentially the same length and width as the Runner to which it is attached, and approximately 1 inch tall.

10. The device of claim 1 hereinabove, wherein:

said Footings are comprised of at least a corresponding triad of essentially parallel longitudinal Footings comprised of a Starboard Lateral Footing extending longitudinally near the Starboard Edge, a Port Lateral Footing extending longitudinally near the Port Edge, and an Axis Footing extending along the longitudinal axis intermediate between the respective Lateral Footings and essentially equidistant therefrom; and the corresponding downstanding height of each Footing tapering down from the Stern End towards the Prow End in an essentially stair-stepped fashion, each Footing thereby having a lowermost essentially stair-stepped longitudinal edge furthest distal to the Lower Plane to enhance slippage prevention of the device along the waterway floor when said Footing edge is submerged into contact with the waterway floor.

11. The device of claim 10 hereinabove, wherein:

each of said Footings extends longitudinally from near the Stern End to near the terminus of the Stern Area, and each of said Footings is comprised of essentially a rectangulo-cuboidal block of footing material having the following approximate ranges of dimensions, essentially permanently attached to the Lower Plane of the Base:

a. 4 inches to about 14 inches long;
b. 1 inch to about 4 inches wide; and
c. essentially stair-stepped tapering down height from between about 8 inches to about 2 inches tall near the Stern End to a height of about 1 inch tall to flush with the Lower Plane near the terminus of the Stern Area.

12. The device of claim 10 hereinabove, wherein:

each of said Footings is comprised of essentially a rectangulo-cuboidal block of footing material having the following approximate dimensions, essentially permanently attached to the Lower Plane of the Base:

a. 12 inches long;
b. 1 inch wide; and
c. essentially stair-stepped tapering down height from about 3¾ inches tall near the Stern End to about flush with the Lower Plane near the terminus of the Stern Area.

13. The device of claim 10 hereinabove, wherein each of said Footings is comprised of an integral protrusion from the Lower Plane comprised of footing material, each of said protrusions having the following approximate ranges of dimensions:

a. 4 inches to about 14 inches long;

b. 1 inch to about 4 inches wide; and c. essentially stair-stepped tapering down height from between about 8 inches to 2 inches tall near the Stern End to a height of about 1 inch tall to about flush with the Lower Plane near the terminus of the Stern Area.

14. The device of claim 10 hereinabove, wherein:

each of said Footings is comprised of an integral protrusion from the Lower Plane comprised of footing material, each of said protrusions having the following approximate dimensions:

a. 12 inches long;

b. 1 inch wide; and c. essentially stair-stepped tapering down height from about 3¾ inches tall near the Stern End to about flush with the Lower Plane near the terminus of the Stern Area.

15. The device of claim 1 hereinabove, further comprising:

at least one Folding Adaptation facilitating the essentially hinged folding of the Base about midway along and essentially perpendicular to the longitudinal axis, facilitating the folding of said apparatus from an Outstretched Position to a Folded Position.

16. The device of claim 15 hereinabove, wherein:

said Folding Adaptation is comprised of the creasing of the Upper Plane of the Base.

17. The device of claim 15 hereinabove, wherein:

said Folding Adaptation is comprised of bisection of the Base along said latitudinal axis, both of said sections of the Base joined by at least one hinge member.

18. The device of claim 2 hereinabove, further comprising:

a corresponding pair of Folding Adaptations, namely a Prow Fold near the terminus of the Prow Area of the Upper Plane and an essentially parallel Stern Fold near the terminus of the Stern Area of the Upper Plane, each such Fold separated from the other by a distance slightly longer than the tallest of the Runners (including any Runner Pads atop said Runners) and allowing folding of the Prow Area of the Upper Plane of the Base inwardly with corresponding inward folding of the Stern Area of the Upper Plane of the Base; and wherein said corresponding pair of Prow Runners and corresponding pair of Lateral Runners are cooperatively aligned to allow such folding without interference by the obstruction of any Runners, thereby resulting in the folding of the device from an Outstretched Position to a Folded Position having the Runners between the inwardly folded Upper Planes.

19. The device of claim 2 hereinabove, further comprising:

at least one corresponding pair of Stabilizing Eyelets, each through one of said Lateral Footings, each respective Stabilizing Eyelet located near the Stern End of the respective Footing and the respective Starboard Edge or the Port Edge, each Stabilizing Eyelet adapted to receive and temporarily tightly anchor an end of essentially elongate securing material the opposite end of which is either similarly received and anchored by the other corresponding Stabilizing Eyelet or secured to the watercraft, said securing material being cinched taut against the watercraft to thereby prevent separation of the watercraft from the respective Runner;

at least one essentially elongate Auxiliary Member having at least a pair of opposite ends, one end of said member being attached to the Base near the Prow End, the opposite end of said member being adapted to facilitate the grasping of the device, said opposite end having a means of temporarily attaching said opposite end near the Stern End once the device is folded into the Folded Position to thereby maintain the device in the Folded Position;

at least one Mooring Eyelet through said Planes near the Prow End and essentially equidistant from the longitudinal axis, adapted to receive a means of mooring the device in the Outstretched Position on the shoreline; and at least one Detection System attached to the submerged device and extending essentially directly upward to the surface of the waterway, to facilitate the location of the device after submersion.

20. The device of claim 19 hereinabove, wherein:

said Auxiliary Member is comprised of nylon strapping, said opposite end of which has a snap member;

said Lower Plane of said Stern End having a corresponding snap member for engaging with the snap member of the auxiliary strap; and said Detection System is selected from the group consisting of at least one elongate antennae extending upwardly to the surface of the waterway and having a flag attached to the apex, or at least one flotation apparatus attached to securing material having sufficient length to allow said flotation apparatus to be visible above the surface of the waterway.

21. A portable device for submerging near the shoreline of a waterway, for supporting and mooring a watercraft therein, comprising:

(a) an essentially planar Base having a Prow End and an essentially opposite Stern End and extending along a longitudinal axis therebetween, essentially bounded by a lateral Port Edge and an essentially opposite lateral Starboard Edge, said Ends and Edges defining an Upper Plane and an essentially opposite Lower Plane of said Base, each respective Plane having a Prow Area and Stern Area, with each respective Prow Area of said Planes comprising an area of the respective Plane essentially defined by the respective Prow End and both respective Edges and a terminus less than but near midway along said longitudinal axis from said Prow End, and with each respective Stern Area of said Planes comprising an area of the respective Plane essentially defined by the respective Stern End and both respective Edges and a terminus less than but near midway along said longitudinal axis from said Stern End;

(b) a corresponding triad of essentially parallel elongate Footings, each Footing downstanding permanently from the Lower Plane and extending longitudinally from near the Stern End to the terminus of the Stern Area, said triad comprised of a Starboard Lateral Footing extending longitudinally near the Starboard Edge, a Port Lateral Footing extending longitudinally near the Port Edge, and an Axis Footing extending along the longitudinal axis intermediate between the respective Lateral Footings and essentially equidistant therefrom, the corresponding downstanding height of each Footing tapering down from the Stern End towards the Prow End in an essentially stair-stepped fashion, each Footing thereby having a lowermost essentially stair-stepped longitudinal edge furthest distal to the Lower Plane preventing slippage of the device along the waterway floor when the device is submerged into contact with the waterway floor, each Footing comprised of an integral protrusion from the Lower Plane comprised of footing material, each Footing having the following approximate dimensions:

a. 12 inches long;

b. 1 inch wide; and c. stair-stepped tapering down height from about 3¾ inches tall near the Stern End to about flush with the Lower Plane near the terminus of the Stern Area;

(c) (1) at least one corresponding pair of essentially rigid Prow Runners and at least one corresponding pair of essentially rigid Lateral Runners, each member of each respective pair of such Runners upstanding permanently from the Upper Plane and separated essentially equidistantly from the other by said longitudinal axis, and extending longitudinally along said longitudinal axis from near the Prow End to near the Stern End, the Prow Runners having, less separation than the separation between the Lateral Runners, the Prow Runners extending longitudinally along, the Prow Area from near the Prow End to near the terminus of the Prow Area while the Lateral Runners extend longitudinally along the Stern Area from near the Stern End to near the terminus of the Stern Area, each of said Prow Runners is comprised of an integral protrusion upstanding from the Upper Plane comprised of runner material, each of said Prow Runners having, the following approximate dimensions:

a. 7½ inches long, b. 2 inches wide, and c. 2¾ inches tall, each of said Lateral Runners is comprised of an integral protrusion upstanding from the Upper Plane comprised of runner material, each of said Lateral Runners having the following, approximate dimensions:

a. 9½ inches long, b. 2 inches wide, and c. 3½ inches tall, (2) each Runner having an apical surface adapted to support a portion of the hull of the watercraft without damaging it, said adaptations of the apical surface of each such Runner comprised of a tiltable Runner Pad having at least one hinged attachment atop the respective Runner, allowing each respective Runner Pad to tilt toward the longitudinal axis sufficient to essentially reflect the prevailing angle of the hull of the watercraft adjacent thereto, each Runner Pad comprised of essentially a rectangulo-cuboidal block of runner material having essentially the same length and width as the Runner to which it is attached, and approximately 1 inch tall; and (d) a corresponding pair of Folding Adaptations of the Base, facilitating the essentially hinged folding of the Base about midway along and essentially perpendicular to the longitudinal axis, said Base adaptations comprising a Prow Fold near the terminus of the Prow Area and an essentially parallel Stern Fold near the terminus of the Stern Area, each Fold comprised of the creasing of the Base and separated from the other Fold by a distance slightly longer than the height of the tallest Runner (including any Runner Pad atop said Runner) and allowing folding of the Prow Area of the Upper Plane of the Base inwardly with corresponding inward folding of the Stern Area of the Upper Plane of the Base thereby facilitating the folding of the device from an Outstretched Position to a Folded Position; and wherein said corresponding pair of Prow Runners and corresponding pair of Lateral Runners are cooperatively aligned to allow such folding without interference by the obstruction of any Runners, thereby resulting in the folding of the device from an Outstretched Position to a Folded Position having the Runners between the inwardly folded Upper Planes.

22. A method of supporting and mooring a watercraft near the shoreline of a waterway, comprising the steps of:

submerging the device of claim 1 hereinabove at or near the shoreline of a waterway, a sufficient depth to allow the desired watercraft to float partially over and between the Runners, floating the prow of the watercraft over and between the corresponding Runner pair(s) until properly positioned to allow the Runner Pads to reflect the angle of the watercraft hull, and securing the watercraft to the device via the stabilizing eyelets and securing members.

* * * * *